US005097948A

United States Patent [19]

Campbell

[11] Patent Number: 5,097,948

[45] Date of Patent: Mar. 24, 1992

[54] CIGARETTE PACK

[75] Inventor: Christopher J. Campbell, Pully, Switzerland

[73] Assignee: Fabriques de Tabac Reunies, S.A., Neuchatel, Switzerland

[21] Appl. No.: 682,248

[22] Filed: Apr. 9, 1991

[30] Foreign Application Priority Data

Apr. 12, 1990 [GB] United Kingdom ..... 9008398

[51] Int. Cl.[5] ..... B65D 85/10

[52] U.S. Cl. ..... 206/268; 206/273; 206/270; 229/131; 229/87.13; 229/146

[58] Field of Search ..... 206/264, 265, 268, 270, 206/271, 273; 229/87.13, 131, 146

[56] References Cited

U.S. PATENT DOCUMENTS 2,958,418 11/1960 O'Gorman ..... 206/268

FOREIGN PATENT DOCUMENTS 3627440 2/1988 Fed. Rep. of Germany ..... 206/268

399434 4/1909 France ..... 206/265

*Primary Examiner*—William I. Price

*Attorney, Agent, or Firm*—Jeffrey H. Ingerman

[57] ABSTRACT

In a hinge lid cigarette pack of which one pair of opposite walls are profiled to project beyond the elevation of the other pair of walls the lid is attached to a profiled wall by an improved hinge structure which does not distort the wall on opening.

6 Claims, 4 Drawing Sheets

Figure 2A:
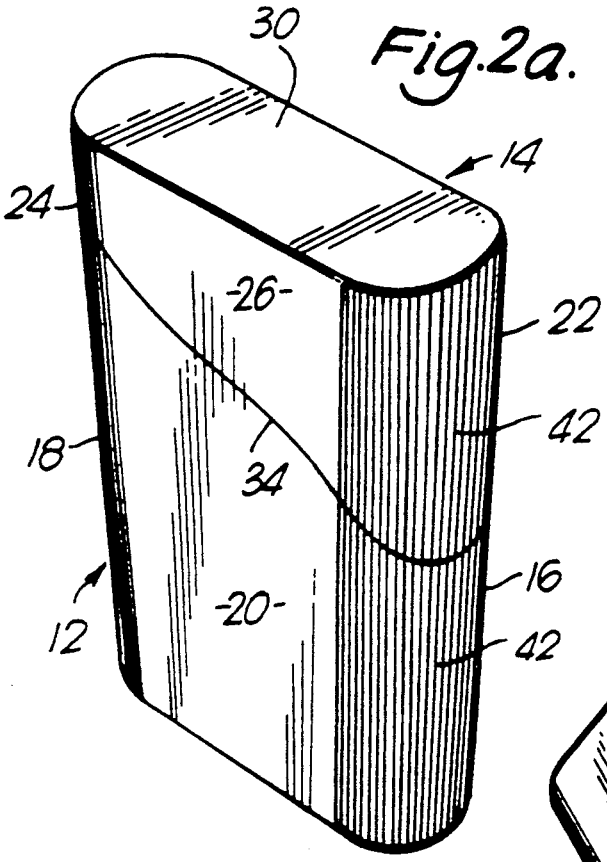

Fig. 1a.
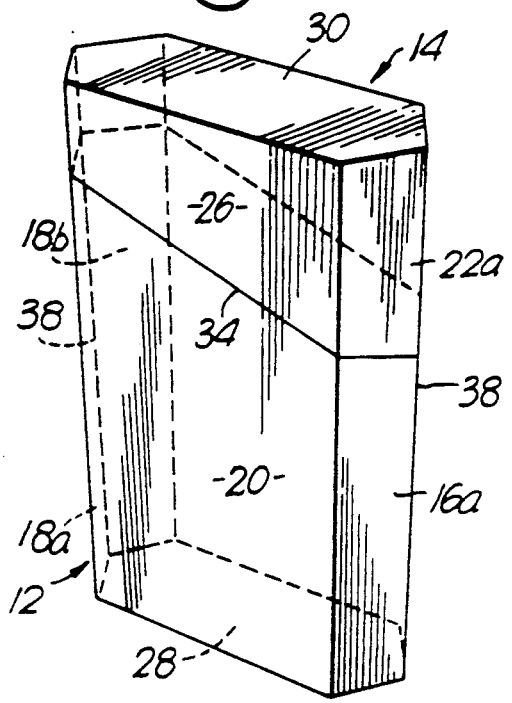
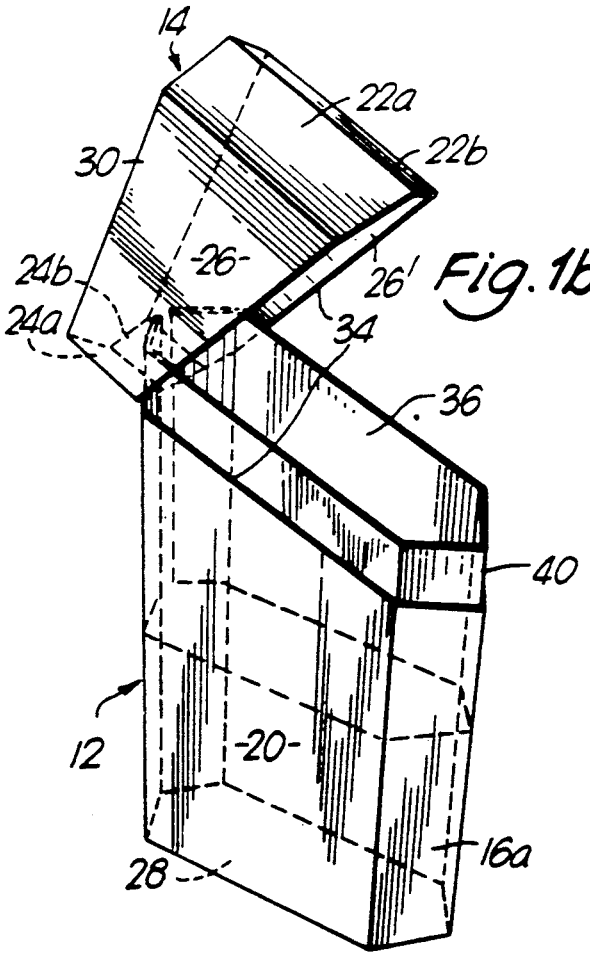
Fig. 1b.

CIGARETTE PACK

The present invention relates to a novel cigarette pack, and particularly to a novel binge lid cigarette pack.

Many designs have been used for the packs in which cigarettes are sold and carried by the smoker. Such packs commonly contain 20 cigarettes, but may contain 10, 25, 30 or some other number. In recent years the so-called hinge lid pack has become popular. This pack, which is usually made of stiff card, is in the form of a rectangular box comprising a lower or body portion and an upper or lid portion, and has wide front and rear walls and narrow side walls. The lid is hinged to the body across the rear wall. The front lid wall is deeper than the rear lid wall, and the lid opening line slopes down from back to front as it crosses the narrow side walls. Packs of this type normally have an inner frame within the pack body, the walls of which extend above the opening line.

It has been proposed, for example in U.S. Pat. No. 2,956,722 (Prussack), to provide a cigarette pack of the hinge lid type, but in which the hinge line is across a narrow wall, rather than a wide wall, of the pack. Blanks from which to form such packs have been disclosed in the same patent and another pack of a similar kind in Swiss Patent No. 385 726 (Wernli).

In a further packaging development packs have been proposed in which two opposite walls, usually but not necessarily the narrower of the two pairs of opposite walls in a generally four sided pack, are not flat. In a further packaging development, packs have been produced in which two opposite walls, usually but not necessarily the narrower of the two pairs of opposite walls, are not flat. In particular, such walls may be angular—leading for example to a pack of hexagonal plan—or arcuate in profile. But if one attempts to locate the hinge on a wall which along the notional hinge line is no longer straight, the simple hinge fold of the prior art is mechanically unsatisfactory and tends to distort the pack walls when opened.

According to the invention this problem is solved by a cigarette pack having rectangular front and rear elevations, with at least one wall of a first pair of opposite walls profiled to project beyond the elevations of a second pair of opposite walls and comprising a pack lid hinged to a pack body, characterised in that the lid is hinged to the body at the said profiled wall by a pair of spaced intermediate hinge portions each connected to the adjacent body and lid portions of the profiled wall by hinge folds, that each intermediate portion has an apex at the angle between the said profiled wall and a respective wall of the second pair, that the base of each portion is separated from the profiled lid and/or body wall portion and the lid wall portion separated from the adjacent profiled body wall portion along the line of the hinge between the pair of intermediate portions by cuts.

It has, moreover, been found that the lids of packs hinged along a narrow wall in a pack with a wider and a narrower pair of walls involve a risk of damage to the cigarettes or the inner frame when opening or closing.

It has been found that this problem can be overcome, in packs of this kind and of any size, by ensuring that the line dividing the lid from the body is so disposed that the height (b) of the narrow wall at the free end of the lid bears a relationship to that (a) of the narrow lid wall at the hinge which is defined by $a/b<0.5$.

It is a particular preference in such packs that the width (w) of the wide front or rear wall of the lid bears a relationship to the height (a) of the hinge end wall defined by $0.45>a/w>0.15$. This ensures that the pack will open and close easily while providing sufficient friction with the pack or its contents to keep the lid closed and sufficient area on the first lid side wall at the hinge end for proper adhesion to adjacent portions during assembly of the pack.

There is also provided, in accordance with the invention, a preferred blank for a pack as described above. The blank which may be cut from a single sheet of carton or board, has panels to form the lid rear wall, the top wall, the lid and body front walls, the bottom wall and the body rear wall, which are disposed sequentially and connected with each other by fold lines. Panels to form the lid and body side walls are disposed adjacent corresponding lid and body front or rear wall panels and are connected therewith by fold lines. Preferably, there are provided at least one pair of inner and outer side wall panels, which in the erected pack overlap and are secured together. The lid front wall panel is separated from the body front wall panel by a cut, extending between the panels from side to side. The free edges of the lid rear wall panel and the body rear wall panel are oriented to correspond. The cut continues across an adjacent side wall, perpendicular to the fold line connecting the front wall to the side wall, to separate a first of the lid side wall panels from a first body side wall panel. The second body side wall panel is connected to the second lid side wall panel by a hinge structure extending across the second side wall generally perpendicular to the fold lines between it and the front and rear wall panels and terminating at one end at the cut, the hinge structure being as defined above. The cut is preferably so disposed that the height of the first lid side wall panel is at least twice that of the second lid side wall panel.

In an alternative form of blank, the panels to form rear, side and front walls of the body are side by side and those of the lid likewise side by side adjacent the corresponding body walls. The blank may thus comprise sequentially a first body side wall panel, a body front wall panel, a second body side wall panel, a body rear wall panel and another first body side wall panel, each connected with the next by fold lines and the two first body side wall panels being intended to provide inner and outer side wall panels to overlap and be secured together in the erected pack. Panels to form a first lid side wall, lid front wall, second lid side wall, lid rear wall and another first lid side wall extend sequentially alongside the body wall panels and are connected with each other by fold lines, the two first lid side wall panels being connected with the first body side wall panels by fold lines but the front, rear and second side wall panels of the lid being separated from those of the body by a cut which extends between the front and rear panels in a manner and for a purpose corresponding to that in the preferred blank described above. The blank also provides inner and outer top panels extending alongside the lid side wall panels and connected therewith by fold lines, and inner and outer bottom panels extending alongside the body side wall panels and connected therewith by fold lines, together with securing tabs connected with the lid and body first and second side wall panels by fold lines but separated from the adjacent top and bottom panels respectively by cuts.

Figure 2B:
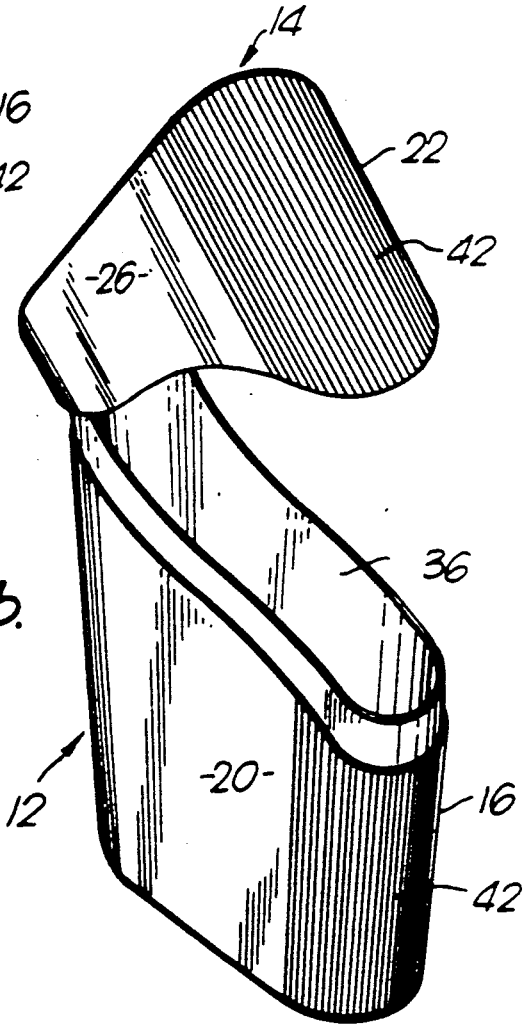
Figure 3A:
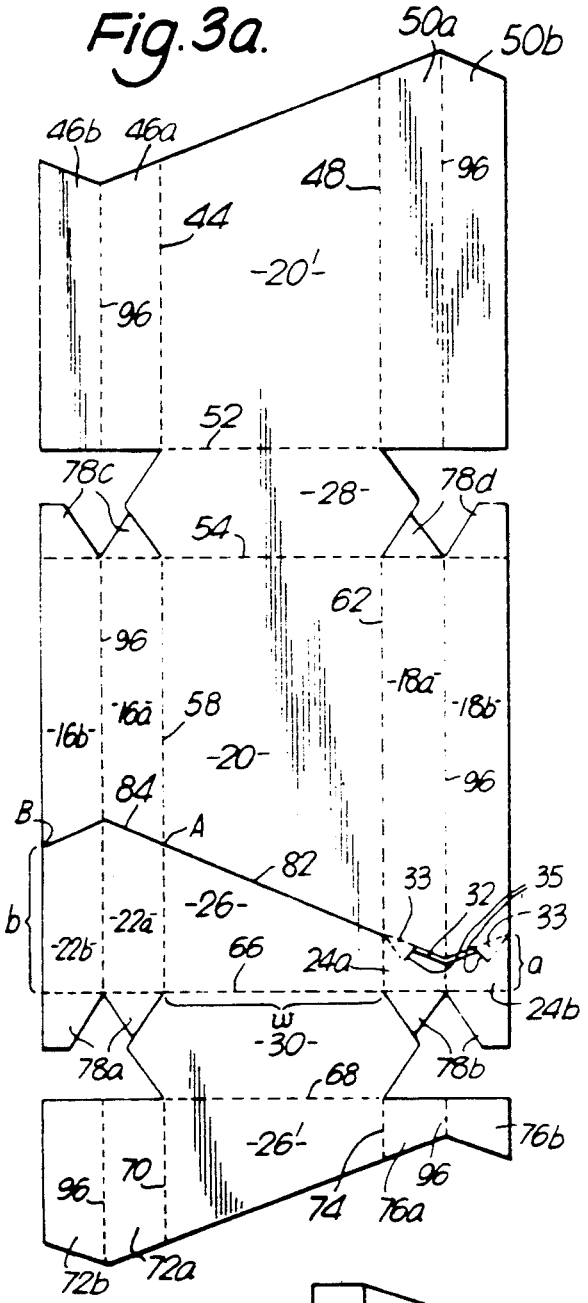
Figure 3B:
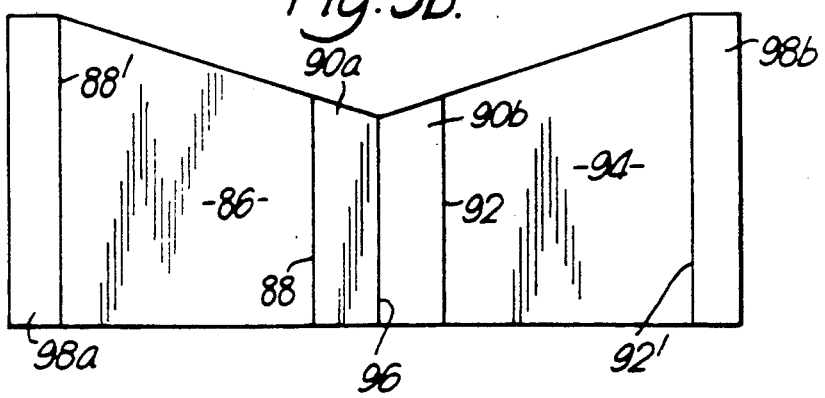
Figure 4:
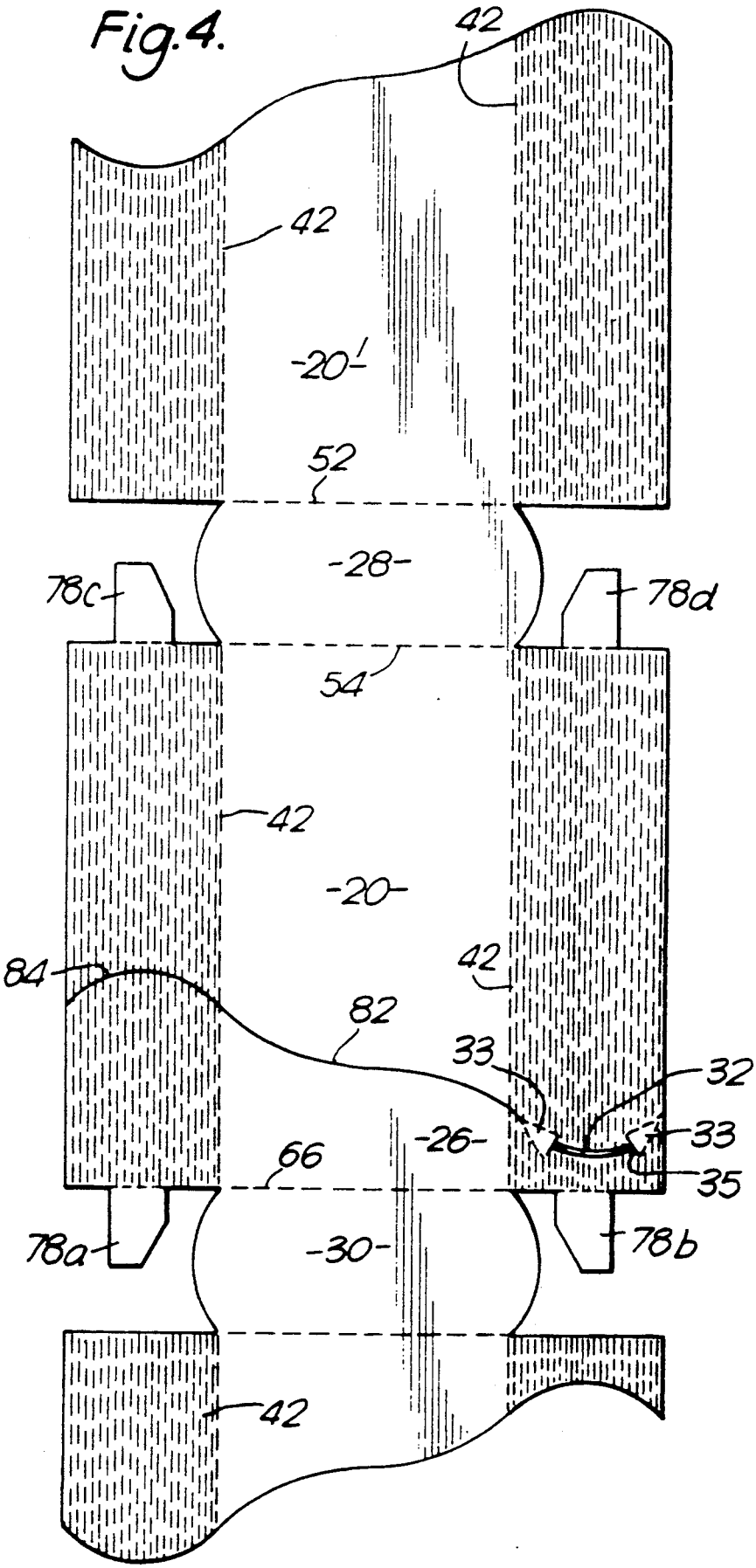

The invention will be further described with reference to the drawings, in which:

FIGS. 1*a* and 1*b* (hereinafter referred to collectively as FIG. 1) show a pack according to a first embodiment of the invention, respectively closed and open;

FIGS. 2*a* and 2*b* (hereinafter referred to collectively as FIG. 2) show a pack according to a second embodiment of the invention, respectively closed and open;

FIGS. 3*a* and 3*b* (hereinafter referred to collectively as FIG. 3) show blanks for a pack according to the first embodiment, shown in FIG. 1;

FIG. 4 shows a blank for a pack according to the second embodiment, shown in FIG. 2.

The cigarette packs of FIGS. 1 and 2 are similar to each other, and like reference numerals are used throughout to denote like parts.

The pack shown in FIG. 1 comprises a body 12 and a lid 14. The body 12 comprises narrow first and second side walls, a front wall 20, and a rear wall 20', not shown in FIG. 1. The lid 14 comprises correspondingly narrow first and second side walls, a front wall 26 and a rear wall 26'. The side walls of the pack body 12 and lid 14 are each divided by a fold line 38 to render the pack hexagonal in plan by formation of pairs of side wall portions or facets 16*a*, 16*b*; 18*a*, 18*b*; 22*a*, 22*b*; and 24*a*, 24*b*. The bottom 28 and top walls 30 are likewise hexagonal, and the inner frame 36 has an extra fold line 40 to enable it to conform to the portions 16*c*, 16*b* of the first side wall of the pack body. The frame also extends inside the second side wall portions 18*a*, 18*b* of the pack body. The pack body bas a bottom wall 28, not shown in FIG. 1, and the pack lid has a top wall 30.

The second side wall 24*a*,*b* of the lid 12 is attached to the second side wall 18*a*,*b* of the body 14 by a hinge structure, described more particularly with reference to FIG. 3*a*. The opening line 34 of the lid slopes down from the second side to the first side of the pack. It is horizontal where it crosses the first side of the pack. The height of the first side wall 22 of the lid is at least twice the height of the second side wall 24 of the lid, in which case the lid will open and close without interfering with cigarettes in the pack.

An inner frame 36 is located inside the pack body 12 around the first side wall and the front and rear walls it extends just above the opening line 34 of the lid, and does not interfere with the lid when the pack is opened and closed.

The pack according to the second embodiment differs from that of FIG. 2 in that the narrow side walls 16,18 and 22,24 of the pack body 12 and lid 14 are bowed and the top 30 and bottom correspondingly shaped. To achieve the desired arcuate profile parallel, embossed crease lines 42 extend for the whole height of the body and lid side walls and are closely spaced round the side walls to ensure a regular curve. The opening line 34 is curved rather than straight, and the inner frame 36 is similarly curved. The hinge structure will be described below in connection with the blank shown in FIG. 4.

It will be appreciated that the variations of the embodiments of FIGS. 1 and 2 may be combined, and that other variations of design are possible.

The blanks shown in FIGS. 3 and 4 are for making the packs shown in FIGS. 1 and 2, respectively. Again, like reference numbers are used through to refer to like parts, and references to up, down, front, rear, side, top, bottom, upper, lower, horizontal and vertical refer to the erect pack. Solid lines in the blanks represent cuts while broken lines represent folded lines.

The blank shown in FIG. 3*a* makes the body and lid of the pack of FIG. 1. It comprises a pack body rear wall panel 20', separated by a fold line 44 from the body first side wall inner portions 46*a* and *b* on one side and by a fold line 48 from a body second side wall inner portions 50*a*,*b*. The upper edge of this panel 20', which forms part of the lid opening line 34 in the pack 10, is free, and the lower edge is separated by a fold line 52 from a bottom wall panel 28. The opposite edge of the bottom wall panel 28 is a fold line 54 separating it from the pack front panel, comprising the body front wall panel 20 and the lid front wall panel 26. One side of the front panel is separated by a fold line 58 from the first side outer panel of the pack, comprising the body first side wall outer portions 16*a* and *b* and the lid first side wall outer portions 22*a*, *b*. The other side of the front panel is separated by a fold line 62 from the second side outer panel, comprising the body second side wall outer portions 18*a* and *b* and the lid second side wall outer portions 24*a*, b. The upper edge of the front panel is a fold line 66 separating it from the top wall panel 30, the opposite edge of which is a fold line 68 separating it from a lid rear wall panel 26'. The lower edge of the panel 26' is free, and forms part of the lid opening line 34 in the erected pack. One side of the lid rear wall panel 26' is separated by a fold line 70 from a lid first side wall inner panel 72. The other side of the lid rear wall panel 26' is separated by a fold line 74 from a lid second side wall inner panel 76. Preferably, four pairs of dust flaps 78*a*, *b*, *c*, *d* are joined to each of the upper and lower ends of the pack side panels by fold lines and lie adjacent each side of the top 30 and bottom 28 wall panels.

The body front wall panel 20 of the front panel is separated from the lid front wall panel 26 by a first cut 82 extending from side to side across the front panel, sloping from the first side to the second side. The body first side wall portions 16*a*,*b* are separated from the lid first side wall outer portions 22*a*,*b* by a second cut 84 extending horizontally across the panel, from an end of the first cut 82. The body second outer cut wall portions 18*a*,*b* are separated from the lid second side wall outer portions 24*a*,*b* by hinge structure described below, extending horizontally across the panel from the other end of the first cut 82. First 82 and second 84 cuts are part of the lid opening line 34 in the erected pack.

The free upper edge of the pack body rear wall panel 20' and lower edge of the pack lid rear wall panel 26' are shaped to conform to the sloping lid opening line of the first cut 82.

The first cut 82 is at such an angle that the height (b) of the lid first side wall portions 22*a*,*b* is at least twice that (a) of the lid second side wall portions 24*a*,*b*. In the example shown, by way of preference, the ratio $b/a=2.5$. Moreover, the ratio of the height (a) of the lid second side wall 24 to the width (w) of the pack front or rear 20 or 20', $a/w=0.18$.

To ensure that the blank travels freely through cigarette packing machinery, the cuts 82, 84 are bridged at A where they meet and at B near the free end of the second cut 84.

To overcome the problem of hingeing the lid to a non-planar side wall, the hinge structure comprises two spaced triangular hinge portions 33, each connected to the adjacent lid and body second sidewall portions 24*a*, 24*b*, 18*a*, 18*b* by respective fold lines constituting two sides of the triangle. The apex of one triangle lies at the corner of the pack defined by the fold line 62 and the apex of the other triangle at the edge of the blank. The base of each triangle is separated from the respective lid second sidewall portion by a cut 35, which allows the lid sidewall portion to flex relative to the triangular hinge portion as well as to the body sidewall. The lid side wall portions are partly separated from the body side wall portions by a cut 32 following the general hinge line between the triangular portions, the lower fold lines of the triangular portions completing the hinge line from the fold 62 to the edge of the blank. The cut 32 is preferably a double cut which, together with the cuts 35 defines a small area which is detached from the blank. This enables the lower edge of the lid side wall portions to pass freely by the upper edge of the body side wall portions during hingeing movement.

A blank for an inner frame 36 is shown in FIG. 3*b*. It comprises a front wall panel 86, a side edge of which is a fold line 88 separating it from one of the first side wall portions 90*a*. The opposite edge of the other first side wall portions 90*b* is a fold line 92 separating it from rear wall panel 94.

The second side wall portions 90*a.b* are divided by a vertical fold line 96 so that they conform to the shape of the body 12 of the pack. Further, left 98*a* and right 98*b* second side wall portions extend from the front 86 and rear 94 wall panels respectively. In the erect pack, these extend inside the second side wall of the pack body.

The blank is erected to form a pack 9 by folding the fold lines other than 32 which forms the hinge in the pack 10. The inner side walls lie inside the outer side walls, and the dust panels lie inside the top and bottom walls. Adhesive in appropriate places holds the pack together. The inner frame 36 is attached inside the body of the pack, and extends into the lid. The blank and inner are normally wrapped around a bundle of cigarettes by machinery to make a pack of cigarettes.

As the pack is first opened, the bridges A and B across the cuts 82, 84 are broken, allowing the lid to open.

FIG. 4 shows a blank for making the pack of FIG. 2. The blank is generally similar to that of FIG. 3*a* although the cuts 82 and 84 defining the line of separation of body and lid follow a complex curve, as do the top and bottom edges of the blank. The blank further differs from FIG. 3*a* in that the side wall inner and outer panels 16,18,22,24 of both body and lid are all covered with closely spaced, parallel, embossed crease lines 42 whereby, on erection, the side walls assume a smoothly curved profile. The top 28 and bottom 30 have curved ends to correspond. The tabs 78*a, b, c, d* are reduced in size in order not to hinder the even curving of the side walls. The curved projection of the side walls again poses a problem in hingeing of the lid, but this problem is solved in accordance with this invention by a structure similar to that shown in FIG. 3*a*, including triangular hinge portions 33 each defined by two fold lines and a cut 35, with a cut 32 extending along the curved hinge line between the cuts 35, the latter preferably being a double cut as explained in relation to FIG. 3*a*.

The blank for the inner frame 36 for the pack of FIG. 4 may resemble that of FIG. 3*b*, but will have an upper edge shaped to correspond with the separation line 34 and parallel crease lines occupying the entire panel 90 and side wall portions 98*a* and *b*.

What is claimed is:

1. A cigarette pack comprising a pack body, a pack lid and a hinge structure hingeing said body to said lid;

said pack body comprising: a bottom wall, a first pair of opposite body walls extending upwardly from said bottom and a second pair of opposite body walls extending upwardly from said bottom and respectively interposed between and interconnecting the body walls of said first pair, at least one of the body walls of said first pair being profiled to project beyond the elevation of said second pair of body walls:

said pack lid comprising: a top wall, a first pair of opposite lid walls depending from said top and a second pair of opposite lid walls depending from said top and respectively interposed between and interconnecting the lid walls of said first pair, at least one of the lid walls of said first pair being profiled to project in similar manner to said at least one of said first pair of body walls beyond the elevation of said second pair of lid walls;

and said hinge structure interconnecting a profiled lid wall of said first pair of lid walls and the corresponding profiled body wall of said first pair of body walls, said binge structure comprising a pair of spaced intermediate hinge portions, each intermediate portion being connected to said profiled lid and body walls by binge folds, each intermediate portion having an apex located at the angle between said profiled lid and body walls and respective walls of the second pair, each intermediate portion having a base which is separated from said profiled lid and/or body wall by a cut and said profiled lid wall being separated from said profiled body wall between said pair of portions by a cut along the general direction of said hinge.

2. A cigarette pack according to claim 1 wherein the cut separating the profiled lid wall adjacent said hinge from the profiled body wall adjacent said binge is a double cut defining a narrow area from which the material constituting said walls has been removed.

3. A cigarette pack according to claim 1 or 2 wherein said lid is divided from said body at said second pair of lid and body walls and at the wall of said first pair of lid and body walls opposite said hinge by a line, said line being so disposed as to define a lid wall at the hinge end of said lid having a height (a) and a lid wall at the end of said lid opposite said hinge having a height (b), said heights bearing a relationship which is defined by $a/b<0.5$.

4. A cigarette pack according to claim 1 or 2 wherein said second pair of lid walls have a width (w) and the wall of said lid at said hinge has a height (a), said width and said height bearing a relationship defined by $0.45>a/w>0.15$.

5. A cigarette pack according to claim 4 wherein:

the wall of said lid at the end of said lid opposite said hinge has a height (b);

$a/b=0.4$; and $a/w=0.18$.

6. A blank for use in the manufacture of a pack, said blank being cut from a single piece of carton or board and comprising:

a lid rear wall panel; a top wall panel; a lid front wall panel; a body front wall panel; a body bottom panel: and a body rear wall panel; said panels being disposed sequentially and interconnected by fold lines;

said blank further comprising: lid side wall panels and body side wall panels; said side wall panels being disposed adjacent corresponding front or rear wall panels and connected therewith by fold lines; said lid front panel and said body front panel being separated by a cut, and adjacent first ones of said lid side wall panels and said body side wall panels being separated by a continuation of said cut, said cut extending at an angle across said front wall panels but extending across said first side wall panels perpendicular to said fold line interconnecting said front wall panels with said first side wall panels;

said blank further comprising a hinge structure interconnecting the second lid side wall panel and second body side wall panel, being the panels opposite said lid and body side wall panels divided by said cut, and extending between said second lid and body side wall panels generally perpendicular to said fold line between said second lid and body side wall panels and said lid and body front wall panels; said hinge structure comprising: a pair of spaced intermediate hinge portions, each intermediate portion being connected to said second lid side wall panel and body side wall panel by hinge folds; each intermediate portion having an apex located at the angle between said second lid and body side wall panels and respective ones of the front and rear wall panels; each intermediate portion having a base which is separated from the adjacent second lid and/or body side wall panel by a cut and said second lid side wall panel being separated from said second body side wall panel between said pair of intermediate portions by a cut along the general direction of said hinge.

* * * * *

UNITED STATES PATENT AND TRADEMARK OFFICE
CERTIFICATE OF CORRECTION

PATENT NO. : 5,097,948

DATED : March 24, 1992

INVENTOR(S) : Christopher J. Campbell

It is certified that error appears in the above-identified patent and that said Letters Patent is hereby corrected as shown below:

Cover Page under "[56] References Cited":
Under "U.S. PATENT DOCUMENTS":
Before "2,958,418 11/1960 O'Gorman ..... 206/268" should be inserted -- 2,956,722 10/1960 Prussack . --;

After "2,958,418 11/1960 O'Gorman ..... 206/268" should be inserted -- 4,266,713 5/1981 Maroszek .
4,792,085 12/1988 Waring, III et al. ... 229/114 --.

Under "FOREIGN PATENT DOCUMENTS":
After "399434 4/1909 France ..... 206/265" should be inserted -- 385726 3/1965 Switzerland .
343451 2/1931 United Kingdom . --.

Column 1, line 5, "binge" should be -- hinge --;
line 29, "development" should be -- development, --.

Column 3, line 31, "bas" should be -- has --;
line 45, "walls it" should be -- walls. It --.

Column 5, line 29, "9" should be deleted.

UNITED STATES PATENT AND TRADEMARK OFFICE

CERTIFICATE OF CORRECTION

PATENT NO. : 5,097,948

DATED : March 24, 1992

INVENTOR(S) : Christopher J. Campbell

It is certified that error appears in the above-identified patent and that said Letters Patent is hereby corrected as shown below:

Claim 1, column 6, line 22, "binge" should be -- hinge --;
line 25, "binge" should be -- hinge --.

Claim 2, column 6, line 36, "binge" should be -- hinge --.

Signed and Sealed this

Twenty-ninth Day of March, 1994

Bruce Lehman

*Attest:*

BRUCE LEHMAN

*Attesting Officer*

*Commissioner of Patents and Trademarks*